US009634450B2

(12) United States Patent
Sugino

(10) Patent No.: US 9,634,450 B2
(45) Date of Patent: Apr. 25, 2017

(54) ELECTRIC WIRE WITH CONNECTOR AND METHOD FOR MANUFACTURING THE SAME

(71) Applicant: YAZAKI CORPORATION, Tokyo (JP)

(72) Inventor: Junki Sugino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/204,504

(22) Filed: Jul. 7, 2016

(65) Prior Publication Data

US 2017/0012384 A1 Jan. 12, 2017

(30) Foreign Application Priority Data

Jul. 9, 2015 (JP) ..... 2015-137919

(51) Int. Cl.
*H01R 13/56* (2006.01)
*H01R 43/00* (2006.01)
*H01R 13/52* (2006.01)

(52) U.S. Cl.
CPC ..... *H01R 43/005* (2013.01); *H01R 13/5205* (2013.01)

(58) Field of Classification Search
CPC ..... H01R 13/58
USPC ..... 439/445, 447, 521, 523
See application file for complete search history.

(56) References Cited

U.S. PATENT DOCUMENTS 2,715,654 A * 8/1955 Lucas ..... H01T 13/06 174/77 S
3,518,600 A * 6/1970 Urani ..... H01H 85/201 174/138 F
4,869,683 A * 9/1989 Nelson ..... H01R 13/5213 174/138 F
5,857,873 A * 1/1999 Castaldo ..... H01R 13/516 439/281
7,056,151 B2 * 6/2006 Cawood ..... H01R 4/70 439/521

(Continued)

FOREIGN PATENT DOCUMENTS

JP 2015-69748 A 4/2015

*Primary Examiner* — Phuong Dinh
(74) *Attorney, Agent, or Firm* — Kenealy Vaidya LLP

(57) ABSTRACT

An electric wire with connector includes: an electric wire; a connector having a housing chamber to house an electric terminal provided at an end of the electric wire, the housing chamber opening on an end surface of the connector; and a waterproof member to cover the housing chamber. The waterproof member includes a sheet member having a width extending from the end surface of the connector as a reference position toward both of the connector and the electric wire. The sheet member has a wrapping shape winding around in a manner to have an overlapped region of the a front surface of one end of the sheet member and a back surface of the other end of the sheet member. The front surface and the back surface are contacted each other at the overlapped region. An inner peripheral surface of an end part of the waterproof member near the connector is contacted to an outer peripheral surface of the connector, and at least part of an inner peripheral surface of the other end part of the waterproof member near the electric wire is contacted to an outer peripheral surface of the electric wire.

4 Claims, 4 Drawing Sheets

(56) References Cited

U.S. PATENT DOCUMENTS

| | | | | |
|---|---|---|---|---|
| 8,480,428 | B1 * | 7/2013 | Sper | H01R 13/5213 439/521 |
| 2015/0090490 | A1 | 4/2015 | Sakka | |

* cited by examiner

ELECTRIC WIRE WITH CONNECTOR AND METHOD FOR MANUFACTURING THE SAME

CROSS-REFERENCES TO RELATED APPLICATION(S)

This application is based on and claims priority from Japanese Patent Application No. 2015-137919 filed on Jul. 9, 2015, and the entire contents of which are incorporated herein by reference.

BACKGROUND

Field of the Invention

This invention relates to an electric wire with connector (hereinafter simply referred to as a "connector wire") and a method for manufacturing the same.

Description of Related Art

Connector wires are conventionally used for electric parts such as vehicle wire harnesses. Such a connector wire typically has an electric wire(s) and a connector to house and hold an electric terminal (crimp terminal) provided at each end of the electric wire(s) in its cavity (housing chamber). In recent years, a connector wire employing aluminum as its conductor (i.e., an aluminum wire) has been developed for this type of connector wire. Although a connector wire using the aluminum wire has an advantage in its light weight and its low cost compared with a connector wire employing copper as its conductor, it might cause a corrosion (so-called galvanic corrosion) of the aluminum conductor due to a difference in natural electric potential between material used as the terminal (typically, copper) and aluminum if liquid reached to a contact region of the terminal and the aluminum conductor.

In particular, a connector wire designed specifically for waterproof purpose (so-called waterproof connector) is widely used, in spite of its high-cost design, under an environment where the connector wire might be poured with water (e.g., in a vehicle engine room) to meet requirements of high-level waterproof property. On the other hand, such a high-level waterproof property required as the waterproof connector is not always required depending on an environment where the connector wire is used (e.g., when a connector wire is used in a vehicle underfloor or in a door). In such cases, a normal connector wire with a simple waterproof function (so-called non-waterproof connector) can be used from a viewpoint of cost reduction.

For example, one of conventional connector wires (hereinafter referred to as a "conventional example") has a flat-band-shaped sheet member (a thick sheet member made of an elastic material, with its one side formed as an adhesive surface) having a width extending over both of a connector and wires. The sheet member is folded in two with its adhesive surface being inside of the folded sheet, thus sandwiching an end of the connector and the wires near the end and being tightly adhered both adhesive surfaces. As a result, the conventional example protects the housing chambers of the connector by the sheet member and achieves an additional simple waterproof function.

As for details of the conventional example, refer to JP 2015-69748 A.

SUMMARY

Tests and considerations performed by the inventor of the present invention have found that using the connector wire for a long time can cause a detachment of the sheet member from the connector due to a phenomenon that the sheet member recovers its original shape by its own elasticity (so-called elasticity recovery). For example, it has found that the detachment (gap enlargement) can cause at a region between the connector and a specific part of the two-folded sheet member where the adhesive surfaces of the sheet member are closely contacted with each other without adhering the connector (e.g., a part where one end and the other end of the sheet member are adhered, hereinafter referred to as an "ear part"), when the two-folded sheet member sandwiches the connector and the wires.

One of the reasons of the detachment (gap enlargement) is that the elastic recovery of the sheet member causes a deform of the sheet member itself (in particular, two parts of the sheet member where the adhesive surfaces are contacted with each other) in a direction to be separated from each other, since the sheet member of the conventional example has a shape that the sheet member is folded in two with its adhesive surface being inside of the folded sheet and the adhesive surfaces are contacted with each other (hereinafter referred to as a "two-folded shape").

The detachment (gap enlargement) can reduce the level of the waterproof property added to the connector wire and affect the reliability of the connector wire when being used for a long time. Consequently, such detachment is preferably eliminated as much as possible.

It is an object of the present invention, in view of the above problems, to provide an electric wire with a connector that enables maintaining its waterproof property when being used for a long time, and to provide a method for manufacturing such electric wire.

Connector wires according to the invention include the following (1) to (3), and a method for manufacturing the connector wire of the invention include the following (4).

(1)

An electric wire with connector comprising:

an electric wire;

a connector having a housing chamber to house an electric terminal provided at an end of the electric wire, the housing chamber opening on an end surface of the connector; and a waterproof member to cover the housing chamber, the waterproof member including a sheet member having a width extending from the end surface of the connector as a reference position toward both of the connector and the electric wire, the sheet member having a wrapping shape winding around in a manner to have an overlapped region of the a front surface of one end of the sheet member and a back surface of the other end of the sheet member, the front surface and the back surface being contacted each other at the overlapped region, an inner peripheral surface of an end part of the waterproof member near the connector being contacted to an outer peripheral surface of the connector, and at least part of an inner peripheral surface of the other end part of the waterproof member near the electric wire being contacted to an outer peripheral surface of the electric wire.

(2)

The electric wire with connector according to item (1), wherein the connector has a lock arm displaceable in a direction crossing the outer peripheral surface of the connector, and the waterproof member has the wrapping shape to locate the overlapped region at a position different from the lock arm.

(3)

The electric wire with connector according to item (1) or (2), wherein the waterproof member has a wrapping shape to locate the overlapped region at a position to cover at least part of the outer peripheral surface of the electric wire.

(4) A method for manufacturing an electric wire with connector, the electric wire with connector including an electric wire; a connector having a housing chamber to house an electric terminal provided at an end of the electric wire, the housing chamber opening on an end surface of the connector; and a waterproof member to cover the housing chamber, the method comprising:

a first step of housing the electric terminal of the electric wire into the housing chamber; and a second step of mounting the waterproof member on the connector and the electric wire, the waterproof member including a sheet member having a width extending from the end surface of the connector as a reference position toward both of the connector and the electric wire, the second step including winding the sheet member around the connector and the electric wire in a manner to locate an inner peripheral surface of an end part of the waterproof member near the connector to be contacted to an outer peripheral surface of the connector and to locate at least part of an inner peripheral surface of the other end part of the waterproof member near the electric wire to be contacted to an outer peripheral surface of the electric wire, to form a wrapping shape having an overlapped region of the a front surface of one end of the sheet member and a back surface of the other end of the sheet member, the front surface and the back surface being contacted each other at the overlapped region.

According to the structure of the item (1), the waterproof member has a wrapping shape including the overlapped region (in other words, a shape in which the sheet member is wound around the connector and its one end (front surface) is overlapped with its other end (back surface)), and does not have such two-folded shape as in the conventional example. Consequently, when the sheet member has recovered elasticity, the sheet member (two sheet members forming the overlapped region) does not deform in a direction to be separated from each other. In particular, two sheet members forming the overlapped region deform substantially in the same direction (direction away from the connector). Accordingly, the electric wire with connector (connector wire) of this structure is hard to cause detachment from the connector when it is used for a long time, compared with the conventional example.

Furthermore, the waterproof member covers the housing chamber of the connector, the end surface of the connector and the electric wire near the housing chamber, since one end (the inner peripheral surface of the connector side end) of the waterproof member having the wrapping shape is closely contacted with the outer peripheral surface of the connector and the other end (at least part of the inner peripheral surface of the wire side end) is closely contacted with the outer peripheral surface of the electric wire. Consequently, exposure of water to the housing chamber of the connector can be eliminated. In addition, the waterproof member of this structure might have the part where one end and the other end of the sheet member are adhered (ear part) around the electric wire depending on thickness and shape, etc., of the electric wire. However, the waterproof member of this structure does not form such part around the connector, and thus maintaining the waterproof function more properly than the conventional example.

Accordingly, the electric wire with connector (connector wire) of this structure can maintain its waterproof function when it is used for a longtime.

The electric wire with connector (connector wire) of this structure provides the following effects in addition to the above-mentioned waterproof function maintaining property. For example, in the conventional example, the ear part can get into contact with peripheral members when mounting the connector wire onto a vehicle, etc., since the ear part projects from the connector. Contact of the ear part with the peripheral members unfavorably can induce or promote the detachment. Furthermore, such detachment induction and promotion caused by the ear part can also be occurred, for example, by a contact of the connector wire with a case for transportation and a contact between the connector wires when the connector wires are inserted into or taken out from the case. In view of this, the conventional example needs consideration to avoid the above contact in mounting the connector wire onto a vehicle, etc., and in inserting it into the transportation case and taking it out from the case, and thus such operation can be complicated when using conventional example. On the other hand, the connector wire of this structure does not have such ear part as in the conventional example around at least the connector, and thus can facilitate the operations such as the transportation of the connector wire and the mounting of the connector wire onto a vehicle, etc., compared with the conventional example.

According to the structure of the item (2), the influence of the overlapped region on the operability of the lock arm can be reduced since the overlapped region (a part where the sheet members are overlapped and thus the total thickness is increased) is located at a position different from the lock arm, even in a case that the area of the closely contacted part of the waterproof member and connector is widen in order to enhance the waterproof function (in other words, in extending the connector side end of the waterproof member toward the front end of the connector). Accordingly, the electric wire with connector (connector wire) of this structure, when the connector includes a lock arm, can enhance the waterproof function while maintaining the operability of the lock arm as much as possible.

According to the structure of the item (3), the sheet member is surely contacted closely with the outer peripheral surface of the electric wire. In particular, when the sheet member is mounted to cover the connector and electric wire, an operator wraps the sheet member on the connector, and then further presses the sheet member against the outer periphery of the electric wire. In this pressing step, the outer peripheral surface of the electric wire is relatively small in curvature, the sheet member is hard to be closely contacted with such outer peripheral surface. In the connector wire of this structure, the overlapped region covers at least part of the outer peripheral surface of the electric wire, and thus the pressing force can be widely dispersed to the respective parts of the sheet member due to its increased thickness, compared with a case where the electric wire is covered with the sheet member of one layer. As a result, the sheet member can be closely contacted with the outer peripheral surface of the electric wire without gap. Accordingly, the electric wire with connector (connector wire) of this structure can surely contacted closely the waterproof member with the outer peripheral surface of the electric wire, and thus enables to enhance its waterproof function.

According to the structure of the item (4), as same as the item (1), the method enables manufacturing a connector wire that is hard to occur detachment (gap enlargement) between the waterproof member and connector when compared with the conventional example. Accordingly, the manufacturing method of this structure can manufacture an electric wire with connector (connector wire) capable of maintaining the waterproof function even when it is used for a long time.

According to the invention, detachment (gap enlargement) is hard to occur between the waterproof member and connector and the waterproof function of the connector wire can be maintained for a long time, compared with the conventional example, The invention is briefly described above. Furthermore, some embodiments of the invention will be described below with some drawings to give clear details of the invention.

DETAILED DESCRIPTION

An electric wire with a connector according to an embodiment of the invention (hereinafter referred to as a "connector wire 1") will be described by referring to FIGS. 1 to 4.

Figure 1:
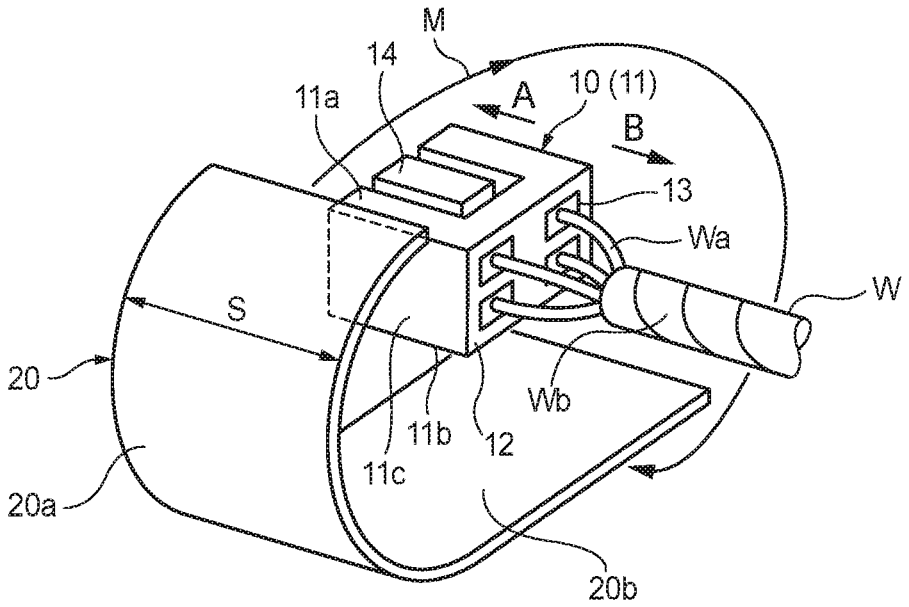
FIG. 1 is a schematic perspective view to illustrate how to wrap a sheet member around a connector and electric wires when manufacturing a connector wire according to an embodiment of the invention.
Figure 2:
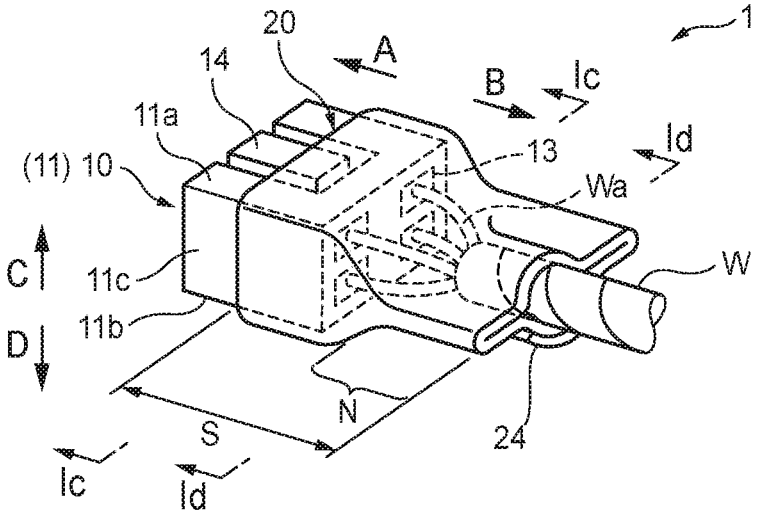
FIG. 2 is a schematic perspective view of a connector wire according to an embodiment of the invention.

As illustrated in FIG. 1 and FIG. 2, the connector wire 1 includes a multi-core cable W formed by bundling a plurality of insulation wires Wa with an adhesive tape Wb (hereinafter simply referred to as an "electric wire W"), a connector 10 located at the end of the multi-core cable W, and a waterproof member 20.

In FIG. 1 and FIG. 2, a direction defined by the arrow A is referred to as a "forward direction", a direction defined by the arrow B is referred to as "backward direction", a direction defined by the arrow C is referred to as an "upward direction", and a direction defined by the arrow D is referred to as a "downward direction".

A crimp terminal (not illustrated) is connected to the end of each insulation wire Wa, which forms the multi-core cable W. Each of the insulation wires Wa, which forms the multi-core cable W, includes a core wire (conductor) and an insulator to cover the core wire. To connect the crimp terminal to the insulation wire Wa, the insulator of the insulation wire Wa is peeled off at its end to expose the core wire, and then the crimp terminal is pressure-connected to the exposed core wire. In this embodiment, each of the insulation wires Wa is made of an aluminum wire, and each crimp terminal is made of metal material containing copper as a main component. In other words, the conductors (core wires) of the electric wires and the terminals, in this embodiment, are made of different kinds of metals.

The connector 10 includes a connector housing 11 which is a synthetic resin molded product, and housing chambers 13 formed in the edge face 12 of the connector housing 11. The crimp terminal (not illustrated) connected to each end of the insulation wires Wa is inserted to the housing chamber 13 from its backward direction to be housed and held. The insulation wires Wa extend to the backward direction B from the housing chambers 13 of the connector housing 11 and are covered by the adhesive tape Wb to form the single multi-core cable W. The waterproof member 20 is arranged to cover the housing chambers 13 (in particular, to seal a gap between the connector housing 11, the multiple insulation wires Wa and multi-core cable W).

The connector housing 11 has a substantially block-like rectangular shape that is longer in the right and left direction than in the vertical direction when viewed from its front surface. The four outer peripheral surfaces of the connector housing 11 include an upper wall 11*a*, a lower wall 11*b*, a left wall 11*c*, and a right wall 11*d*. A lock arm (lock part) 14 is located at a central position of the upper wall 11*a* of the connector housing 11 in its width direction. The lock arm 14 is displaceable in the upper and lower directions C, D (directions crossing the outer peripheral surface of the connector housing 11). The lock arm 14 is engaged with a lock part (not illustrated) provided in a counterpart connector when the connector 10 is engaged with the counterpart connector to engage those connectors with each other. In addition, the shape of the connector housing 11 is not limited to the above-mentioned shape, but the connector wire of the invention can use connector housings having various shapes. For example, the shape of the connector housing may include a substantially block-like rectangular shape that is longer in the vertical direction than in the right and left direction when viewed from its front, a substantially block-like square shape when viewed from its front, a circular or elliptic shape when viewed from its front, and a shape that its outer peripheral surface is not flat.

The waterproof member 20 includes a sheet member 20 having a width S extending from a reference position (which is the backward edge surface 12 of the connector housing 11) to both of the connector housing 11 side (front side A) and electric wire side (back side B). The sheet member 20 also has a wrapping shape that it is wound around in a manner to have an overlapped region where the front surface of its one end part and the back surface of its other end part are contacted with each other. In this embodiment, the waterproof member and the sheet member are given the same reference numeral (20) since the waterproof member is substantially the same as the sheet member.

In particular, the sheet member 20 before wound has a substantially rectangular flat-band shape. The sheet member 20 is made of a base body integrally formed of an independent-bubble foamed body or a semi-independent-bubble foamed body. The base body has an adhesive surface in one surface thereof. The sheet member has elasticity. The sheet member 20 is wound one or more rounds in the M direction of FIG. 1 around the outer peripheral surface of the connector housing 11 and the outer peripheral surface of the electric wire W, with its non-adhesive surface being an outer peripheral surface (front surface) 20*a* and its adhesive surface being an inner peripheral surface (back surface) 20*b*, to have a cylindrical shape (the wrapping shape). In other words, the sheet member 20 is not wound spirally. As a result of the shape, the width S of the sheet member 20 and the length of the waterproof member 20 having the shape in the forward and backward direction (direction from the connector 10 toward the electric wire W) are substantially the same.

Figure 3:
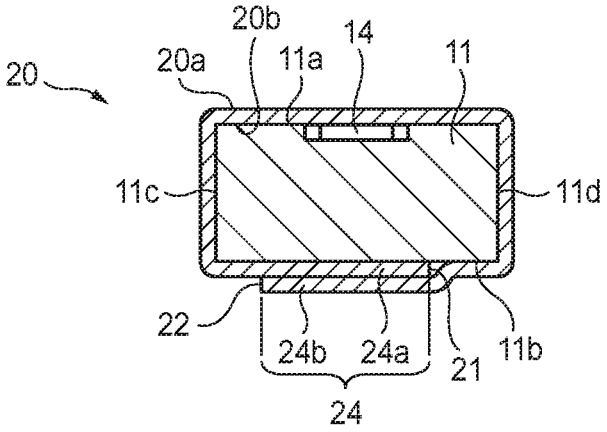
FIG. 3 is a cross-sectional view of the Ic-Ic line in FIG. 2.
Figure 4:
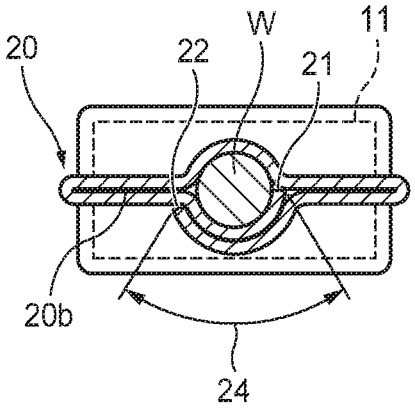
FIG. 4 is a cross-sectional view of the Id-Id line in FIG. 2.

Furthermore, as illustrated in FIG. 3 and FIG. 4, the sheet member 20 is wound up to a position where a wrap end part 22 goes beyond a wrap start part 21, and thus the inner peripheral surface 20*b* (adhesive surface, back surface) of a later wound part 24*b* is closely overlapped with the outer peripheral surface 20*a* (front surface) of an earlier wound part 24*a*. Consequently, an overlapped region 24 is formed.

As illustrated in FIG. 2, the inner peripheral surface 20*b* (adhesive surface) of the connector-side end of the cylindrical sheet member 20 is closely connected to the outer peripheral surface of the connector housing 11, and the inner peripheral surface 20*b* (adhesive surface) of the wire-side end of the cylindrical sheet member 20 is closely connected to the outer peripheral surface of the electric wire W. Furthermore, at the overlapped region 24, the inner peripheral surface 20*b* (adhesive surface) of the later wound part 24*b* is closely contacted to the outer peripheral surface 20*a* of the earlier wound part 24*a*.

The overlapped region 24 is arranged on the lower wall 11*b* opposed to the upper wall 11*a* in which the lock arm 14 is located. In other words, the sheet member 20 is wound in a single layer on the upper wall 11*a*. The front end side of the sheet member 20 may preferably extend to the forward direction as much as possible from the end surface 12 of the connector housing 11 so long as the function of the connector 10 is not disturbed, from a viewpoint of enhancing the waterproof property. In other words, the close contact region of the waterproof member 20 and connector 10 may preferably widen as much as possible. In view of this, the front end of the sheet member 20 is overlapped with part of the lock arm 14 in this embodiment. However, when the sheet member 20 is overlapped with part of the lock arm 14, the operability of the lock arm 14 is maintained as described below.

The overlapped region 24 of the sheet member 20, as illustrated in FIG. 4, is arranged to cover at least a part of the outer peripheral surface of the electric wire W. The sheet member 20 is formed to have a plate-like shape in which, as illustrated in FIG. 2, a part N wound around the outer periphery of the electric wire W is crushed from upper and lower directions with the electric wire W sandwiched therein, thus part of the inner peripheral surface 20*b* is closely contacted with the outer peripheral surface of the electric wire W and also the remaining parts of the inner peripheral surface 20*b* are closely contacted with each other.

In addition, the independent-bubble foamed body or semi-independent-bubble foamed body used as the base body of the sheet member 20 is made mainly of EPDM (ethylene-propylene-diene rubber). The independent-bubble foamed body has air bubbles structured independent of each other, thereby providing a sufficient waterproof property over the whole bubble body. On the other hand, the semi-independent-bubble foamed body has air bubbles partially structured being connected, thus there exists a waterproof property lacking part. However, when it is applied to a location where a relatively lower waterproof property is required, it can adequately meet the required waterproof property. For example, as the independent-bubble foamed body, EPTSEALER (independent-bubble foamed type) manufactured by Nitto Denko Corp. Co., Ltd. and EVERLIGHT MORAN manufactured by Bridgestone formation product Co., Ltd. can be employed. "EPTSEALER and "EVERLIGHT MORAN" are both registered trademarks.

Next, a method for manufacturing the connector wire 1 will be described below.

Firstly, the crimp terminal (not illustrated) connected to the end of the electric wire W is stored into the housing chamber 13 of the connector housing 11 (a first step).

Next, the waterproof member 20 is mounted on the connector 10 and electric wire W (a second step). In particular, a sheet member 20 having a width S extending from a reference position (which is the backward edge surface 12 of the connector housing 11) to both of the connector housing 11 side (front side A) and electric wire side (back side B) is prepared, and the sheet member 20 is wound around the outer peripheral surface of the connector housing 11 and the outer peripheral surface of the electric wire W to have a wrapping shape having an overlapped region 24 where the front surface of its one end part and the back surface of its other end part are contacted with each other. In this case, the inner peripheral surface of the end part of the sheet member 20 facing the connector housing 11 is wound on the periphery of the connector housing 11 to be closely contacted with the outer peripheral surface of the connector housing 11, and the wrapping end part 22 is allowed to reach a position beyond the wrapping start part 21 as illustrated in FIG. 3. As a result, the inner peripheral surface 20*b* of the later wound part 24*b* is closely overlapped with the outer peripheral surface 20*a* of the earlier wound part 24*a*. Then, part of the inner peripheral surface 20*b* of the sheet member 20 facing the electric wire W is closely connected to the outer peripheral surface of the electric wire W, and the remaining parts of the inner peripheral surface 20*b* are closely contacted with each other.

The above is the description relating to the connector wire 1 according to this embodiment.

According to the connector wire 1 of this embodiment, the wrapping end part 22 of the sheet member 20 is wound up to a position beyond the wrapping start part 21, whereby the inner peripheral surface 20*b* of the later wound part 24*b* is closely overlapped with the outer peripheral surface 20*a* of the earlier wound part 24*a*. Thus, the connector wire 1 does not have such two-folded shape as in the conventional example. Consequently, when the sheet member 20 has recovered elasticity, the sheet member 20 (two sheet members that are closely contacted with each other when folded in two) does not deform in a direction to be separated from each other near the connector 10 unlike the conventional example. As a result, the sheet member 20 of the connector wire 1 is hard to cause detachment from the connector 10 when it is used for a long time, compared with the conventional example. Accordingly, the connector wire 1 can maintain its waterproof function when it is used for a longtime.

Furthermore, the sheet member 20 has a width S extending from a reference position (which is the backward edge surface 12 of the connector housing 11) to both of the connector housing 11 side (front side A) and electric wire side (back side B), and the width allows the sheet member 20 to cylindrically wrap only one round in a manner to cover both of the connector 10 and electric wire (multi-core cable) W to cover the necessary part surely. This eliminates producing gaps between adhesive tapes, when compared with a case where an adhesive tape having a narrow width is wound spirally several rounds.

Furthermore, the sheet member 20 is made of the independent-bubble foamed body or semi-independent-bubble foamed body, and it allows the sheet member 20 to cover the insulation wire Wa extending from the connector 10 while eliminating an excessively small curvature and maintaining a certain degree of bendability. Additionally, the independent-bubble foamed body and semi-independent-bubble foamed body does not include connected bubbles unlike a connected bubble body such as urethane, it allows the sheet member 20 to eliminate water passing through the sheet member via the bubbles. As a result, when an aluminum wire is employed as the insulation wire Wa, a required waterproof property can be easily added to a connector wire.

Furthermore, according to the connector wire 1 of this embodiment, while the front end of the sheet member 20 is overlapped with part of the lock arm 14, the overlapped region 24 of the sheet member 20 is located at a different position from the lock arm 14 (on the lower wall 11*b* opposed to the lock arm 14). It allows the sheet member 20 to reduce its influence on the operability of the lock arm 14. In other words, since the part having an increased thickness due to overlapping with the sheet member 20 (overlapped region 24) is disposed to avoid the lock arm 14, a relatively smaller thickness part (in this embodiment, the single-layer sheet member 20) is overlapped with the lock arm 14, whereby the influence of the sheet member 20 on the operability of the lock arm 14 is small.

Furthermore, since the wrapping end part 22 of the sheet member 20 is situated on the flat lower wall 11*b* of the connector housing 11, other members are hard to interfere with the wrapping end part 22 which is easy to become a starting point of the detachment of the sheet member 20. Thus, the sheet member 20 is hard to detach with the wrapping end part 22 as the starting point. In addition, when the wrapping end part 22 is located at the corner of the outer periphery of the connector housing 11 (a ridge line part where the lower wall 11*b* and the left and right walls 11*i*, 11*d* cross each other), other members are easy to interfere with the wrapping end part 22 and the sheet member 20 is easy to detach with the wrapping end part 22 as the starting point. This embodiment reduces the possibility of such detachment.

Furthermore, according to the connector wire 1 of this embodiment, the sheet member 20 can be closely contacted with the outer peripheral surface of the electric wire (multi-core cable) W as much as possible. In other words, when the sheet member 20 is mounted to cover the connector 10 and electric wire W, an operator wraps the sheet member 20 on the outer periphery of the connector 10 and the outer periphery of the electric wire W by hand work, and then further presses the sheet member 20 against the outer periphery of the connector 10 and the outer periphery of the electric wire W. In this case, since the outer peripheral surface of the electric wire W is relatively small in curvature, the sheet member 20 is hard to be closely contacted with such outer peripheral surface. This can cause a gap enlargement between the outer peripheral surface of the electric wire W and sheet member 20.

However, as illustrated in FIG. 4, at least part of the outer peripheral surface of the electric wire W is covered with the overlapped region 24 (sheet member 20 of two or more layers) in this embodiment. When the outer peripheral surface of the electric wire W is covered with the sheet member 20 of two or more layers, the pressing force can be easily dispersed uniformly to the respective parts of the sheet member 20 due to its increased thickness, compared with a case where the electric wire W is covered with the sheet member 20 of one layer. Consequently, deviation of the pressing forces at the respective positions can be reduced. Thus, while reducing variations in the degrees of close contact at the respective positions, the sheet member 20 can be closely contacted with the outer peripheral surface of the electric wire W. it allows the sheet member 20 to enhance in waterproof function.

According to the connector wire 1 of this embodiment, the part N of the sheet member 20 wound on the outer peripheral surface of the electric wire W is crushed from both sides (upward and downward directions) with the electric wire W interposed between them, whereby the part N is formed into a plate-like shape in which the mutually opposed inner surfaces (inner peripheral surfaces 20*b*) are closely contacted with each other. Consequently, it allows the sheet member 20 to cover the insulation wire Wa extending from the connector 10 while eliminating an excessively small curvature and maintaining a certain degree of bendability.

In this case, since the bending rigidity of the plate-shaped part increases in directions along the plate surface (right and left directions), the bending in such directions can be reduced more.

The invention is not limited within the above specific embodiments, various modifications corrections may be made without departing from the scope of the invention.

For example, in the above embodiment, the sheet member 20 is made of the independent-bubble foamed body or semi-independent-bubble foamed body. However, the sheet member 20 may be made of material having a waterproof property and elasticity and is not limited to the independent-bubble foamed body or semi-independent-bubble foamed body.

Furthermore, for example, in the above embodiment, the aluminum wire is used. However, the connector wire of the invention may also be made of other electric wire (for example, copper wire) than the aluminum electric wire.

Here, the characteristics of the above embodiment of the connector wire of the invention are described briefly as the following item (1) to (3), and the characteristic of the method for manufacturing the embodiment of the connector wire of the invention are described briefly as the following item (4).

(1)

An electric wire with connector (1) comprising:

an electric wire (W);

a connector (10) having a housing chamber (13) to house an electric terminal provided at an end of the electric wire, the housing chamber (13) opening on an end surface (12) of the connector; and a waterproof member (20) to cover the housing chamber, the waterproof member (20) including a sheet member (20) having a width extending from the end surface (12) of the connector as a reference position toward both of the connector and the electric wire, the sheet member having a wrapping shape winding around in a manner to have an overlapped region (24) of the a front surface (20*a*) of one end of the sheet member and a back surface (20*b*) of the other end of the sheet member, the front surface (20*a*) and the back surface (20*b*) being contacted each other at the overlapped region (24), an inner peripheral surface of an end part of the waterproof member (20) near the connector (10) being contacted to an outer peripheral surface of the connector, and at least part of an inner peripheral surface of the other end part of the waterproof member (20) near the electric wire (W) being contacted to an outer peripheral surface of the electric wire.

(2)

The electric wire with connector according to item (1), wherein the connector (10) has a lock arm (14) displaceable in a direction crossing the outer peripheral surface of the connector, and the waterproof member (20) has the wrapping shape to locate the overlapped region (24) at a position different from the lock arm (14).

(3)

The electric wire with connector according to item (1) or (2), wherein the waterproof member (20) has a wrapping shape to locate the overlapped region (24) at a position to cover at least part of the outer peripheral surface of the electric wire (W).

(4) A method for manufacturing an electric wire with connector, the electric wire with connector including an electric wire (W); a connector (10) having a housing chamber (13) to house an electric terminal provided at an end of the electric wire, the housing chamber (13) opening on an end surface (12) of the connector; and a waterproof member (20) to cover the housing chamber, the method comprising:

a first step of housing the electric terminal of the electric wire (W) into the housing chamber (13); and a second step of mounting the waterproof member (20) on the connector (10) and the electric wire (W), the waterproof member including a sheet member (20) having a width extending from the end surface (12) of the connector as a reference position toward both of the connector and the electric wire, the second step including winding the sheet member (20) around the connector (10) and the electric wire (W) in a manner to locate an inner peripheral surface of an end part of the waterproof member (20) near the connector to be contacted to an outer peripheral surface of the connector (10) and to locate at least part of an inner peripheral surface of the other end part of the waterproof member (20) near the electric wire to be contacted to an outer peripheral surface of the electric wire (W), to form a wrapping shape having an overlapped region (24) of the a front surface of one end of the sheet member and a back surface of the other end of the sheet member, the front surface and the back surface being contacted each other at the overlapped region.

REFERENCE SIGNS LIST

1: Electric wire with connector
10: Connector
12: Edge face of the connector
13: Housing chamber
14: Lock arm
20: Waterproof member (sheet member)
24: Overlapped region
W: Electric wire

The invention claimed is:

1. An electric wire with connector comprising:

an electric wire;

a connector having a housing chamber to house an electric terminal provided at an end of the electric wire, the housing chamber opening on an end surface of the connector; and a waterproof member to cover the housing chamber, the waterproof member including a sheet member having a width extending from the end surface of the connector as a reference position toward both of the connector and the electric wire, the sheet member having a wrapping shape winding around in a manner to have an overlapped region of the a front surface of one end of the sheet member and a back surface of the other end of the sheet member, the front surface and the back surface being contacted each other at the overlapped region, an inner peripheral surface of an end part of the waterproof member near the connector being contacted to an outer peripheral surface of the connector, and at least part of an inner peripheral surface of the other end part of the waterproof member near the electric wire being contacted to an outer peripheral surface of the electric wire.

2. The electric wire with connector according to claim 1, wherein the connector has a lock arm displaceable in a direction crossing the outer peripheral surface of the connector, and the waterproof member has the wrapping shape to locate the overlapped region at a position different from the lock arm.

3. The electric wire with connector according to claim 1 or 2, wherein the waterproof member has a wrapping shape to locate the overlapped region at a position to cover at least part of the outer peripheral surface of the electric wire.

4. A method for manufacturing an electric wire with connector, the electric wire with connector including an electric wire; a connector having a housing chamber to house an electric terminal provided at an end of the electric wire, the housing chamber opening on an end surface of the connector; and a waterproof member to cover the housing chamber, the method comprising:

a first step of housing the electric terminal of the electric wire into the housing chamber; and a second step of mounting the waterproof member on the connector and the electric wire, the waterproof member including a sheet member having a width extending from the end surface of the connector as a reference position toward both of the connector and the electric wire, the second step including winding the sheet member around the connector and the electric wire in a manner to locate an inner peripheral surface of an end part of the waterproof member near the connector to be contacted to an outer peripheral surface of the connector and to locate at least part of an inner peripheral surface of the other end part of the waterproof member near the electric wire to be contacted to an outer peripheral surface of the electric wire, to form a wrapping shape having an overlapped region of the a front surface of one end of the sheet member and a back surface of the other end of the sheet member, the front surface and the back surface being contacted each other at the overlapped region.

* * * * *